United States Patent [19]

Baduel et al.

[11] 4,441,839

[45] Apr. 10, 1984

[54] ECCENTRIC FLUID DELIVERY COLUMN FOR ARTICULATED DRILLING PLATFORM IN DEEP WATER PETROLEUM PRODUCTION

[75] Inventors: Francois Baduel, Tarbes; Christian Dumazy, Idron; Jean-Paul Sarrailh, Pau, all of France

[73] Assignee: Societe Nationale Elf Aquitaine, Courbevoie, France

[21] Appl. No.: 419,448

[22] Filed: Sep. 17, 1982

[30] Foreign Application Priority Data

Sep. 18, 1981 [FR] France ..... 81 17642

[51] Int. Cl.[3] ..... E02B 17/02

[52] U.S. Cl. ..... 405/202; 166/367

[58] Field of Search ..... 405/169, 195, 202; 166/343, 350, 359, 367

[56] References Cited

U.S. PATENT DOCUMENTS

| | | | |
|---|---|---|---|
| 3,677,016 | 7/1972 | Garrigus | 405/202 |
| 3,690,108 | 9/1972 | Tam | 405/202 |
| 4,273,470 | 6/1981 | Blomsma et al. | 405/202 |
| 4,326,312 | 4/1982 | Tang | 405/202 X |

FOREIGN PATENT DOCUMENTS

| | | | |
|---|---|---|---|
| 2646134 | 4/1978 | Fed. Rep. of Germany | 405/202 |

*Primary Examiner*—David H. Corbin

*Attorney, Agent, or Firm*—Burgess, Ryan and Wayne

[57] ABSTRACT

An arrangement for supporting a well pipe emerging from the sea bottom adjacent a drilling platform which is articulated on a base by means of a universal joint, the base being mounted on the sea bottom adjacent the point where the well pipe emerges. A second base surrounds the portion of the well pipe emerging from the sea bottom, and supports a cylindrical seat by means of a universal joint at a point vertically aligned with the well pipe and horizontally aligned with the universal joint which supports the drilling platform. The upper part of the cylindrical seat surrounds the well pipe in such a manner that the well pipe can slide longitudinally within the seat. A generally horizontal arm is articulated at one end to the drilling platform at a point vertically above the universal joint which supports the platform. The other end of the arm is articulated to the upper part of the cylindrical seat at a point aligned with the well pipe, so that the articulations of the arm, the universal joint which supports the drilling platform, and the universal joint which supports the cylindrical seat define the vertices of a parallelogram. The universal joint which supports the cylindrical seat is disposed midway between the sea bottom and the upper part of the cylindrical seat to which an end of the arm is articulated. With this arrangement, bending stresses on the portion of the well pipe emerging from the sea bottom resulting from pivoting of the drilling platform on its supporting universal joint, are maintained at approximately the same level as if the well pipe coincided with the central vertical axis of the drilling platform.

7 Claims, 9 Drawing Figures

ECCENTRIC FLUID DELIVERY COLUMN FOR ARTICULATED DRILLING PLATFORM IN DEEP WATER PETROLEUM PRODUCTION

BACKGROUND OF THE INVENTION

This invention relates to a delivery column for articulated structures in deep water petroleum production; and is particularly suited for but not limited to, a conduit structure for delivering fluid from a well in the sea floor.

FIELD OF THE INVENTION

Different types of undersea well delivery columns are known, which are centered in a pipe guide integral with an articulated supporting structure by means of elastic centering elements; which columns extend between the platform atop the articulated structure and a level in the order of 20 meters above the sea bottom.

Such a column is normally connected to a base pipe by a union equivalent to a housing, and supported on the well guide by means of elastic centering elements. The lower part of the column acts like a cantilever beam, so that bending stresses are unequally distributed along it, not only between the union on the base pipe and the first centering element, but also beyond the first centering element.

In a bent position of the column, the bending moment at each point is a function of the radius of curvature of the column at that point. The deflection curve of the column, for a given inclination of the articulated structure, then depends on (i) the characteristics of the centering elements and particularly of the centering element situated farthest down in the well guide on (ii) the state of the centering elements, (iii) on the amplitude of displacement of the centering elements from their rest position.

DESCRIPTION OF THE PRIOR ART

In French Patent No. 2,307,949, applied for on Apr. 14, 1975, a well delivery column is described, consisting of production tubing members centered and free to move in translation in a well guide integral with the articulated structure, wherein the delivery column contains a lower member connected at one end to a base pipe by means of a disconnecting coupler remote controlled from the surface, and on the other end to the adjacent production tubing member by a piston sliding longitudinally into a cylindrical seat formed by the lower section of the well guide.

In an installation according to French Patent No. 2,307,949, the bending deformations of the column are localized along the lower member of the column, and fatigue is manifested only on that lower member, which is specially monitored by control means and is treated as a wear part.

In this prior arrangement, however, the space necessary for the equipment situated over the base, such as wellheads, requires off-centering of the delivery column by a rather considerable distance. The stresses due to off-centering thus become considerable and movements relative to the level of the sliding piston become such that they raise problems of interference between guide parts.

SUMMARY OF THE INVENTION

The present invention overcomes the aforementioned difficulties and eliminates the problems associated with the off-centering of well delivery columns by subjecting those columns to the same stresses and displacements as those to which a column arranged along the axis of the articulated structure would be subjected.

According to a feature of the invention, a delivery column for an articulated structure in deep water petroleum production, resting on a first base by a means capable of angular deflection of the axis of the structure from the vertical, such as a universal joint, a swivel joint or a hose, contains a multiple number of pipes connected to each other, comprising a tubular part rising near the surface of the water, and a lower tubing member connected at one end to a base pipe by means of a disconnecting coupler and to the base itself by a housing; and connected at the other end to the lower end of the tubular part of the column by means of a coaxial union comprising a piston telescoping into a cylindrical seat.

A delivery column, according to a preferred embodiment of the invention, is characterized in that this seat is connected:

- on one side to the structure by means of a first articulated arm, the axis of one of the articulated ends of which meets the axis of the structure, and the axis of the other articulated end of which meets the axis of the column; the axes of both articulated ends being perpendicular to the plane defined by the axis of the structure and the axis of the column;

- on the other side of the structure to a second base by means of a second arm extending the seat and resting on that second base by means of a universal joint, swivel joint or hose, the center of which is situated on the same side as the center of the means of angular deflection of the axis of the structure such as a universal joint, a swivel joint or a hose; the center of the second universal joint being on the vertical of the center of the base housing of the lower tubing member; that second arm being such that the axis of the seat passes through the center of the universal joint, the centers of the means of deflection and of the universal joint and the centers of the two end articulations of the first lever being preferably the vertices of a parallelogram.

According to one preferred version of such a delivery column, the distance between the center of the seat and the center of the universal joint is approximately equal to the distance between the center of the universal joint and the base housing of the lower tubing member.

In different embodiments, the articulatd arms are equipped at each end with a stirrup containing two diametrically opposite bearings capable of receiving supporting pins, those pins being respectively fixed at two diametrically opposite points of a straight section of the seat or of the pipe and of a straight section of the structure.

According to some embodiments, the seat is extended to the upper level of the structure by a well guide, on the inner wall of which, centering elements integral with the straight tubular part of the column are borne, the means of connection between the straight tubular part of the column and the structure consisting of a multiple number of arms which each connect (i) an axis at right angles to the axis of the well guide and are situated a distance away from the second universal joint and (ii) an axis at right angles to the structure axis and situated the same distance away from the means of angular deflection of the axis of the structure from the vertical.

According to other embodiments, the seat has a length somewhat greater than the maximum amplitude of displacement of the piston, the tubular part of the column is free over a distance of several tens of meters from the piston and then kept appreciably straight along the axis of a well guide by a plurality of centering elements, that well guide being fixed along the structure and having its axis parallel to the axis thereof.

In still other embodiments, the seat is combined with at least one other cylindrical seat having an axis parallel to the axis of the first mentioned seat, articulated on the same stirrup and suitable for passage of a column combined with the first mentioned column.

In the embodiments in which two columns are combined with a structure, so that the articulations of the corresponding stirrups form a given angle, the stirrup connected to the column has a hole for passage of the other stirrup combined with the other column.

IN THE DRAWING

Figure 1:
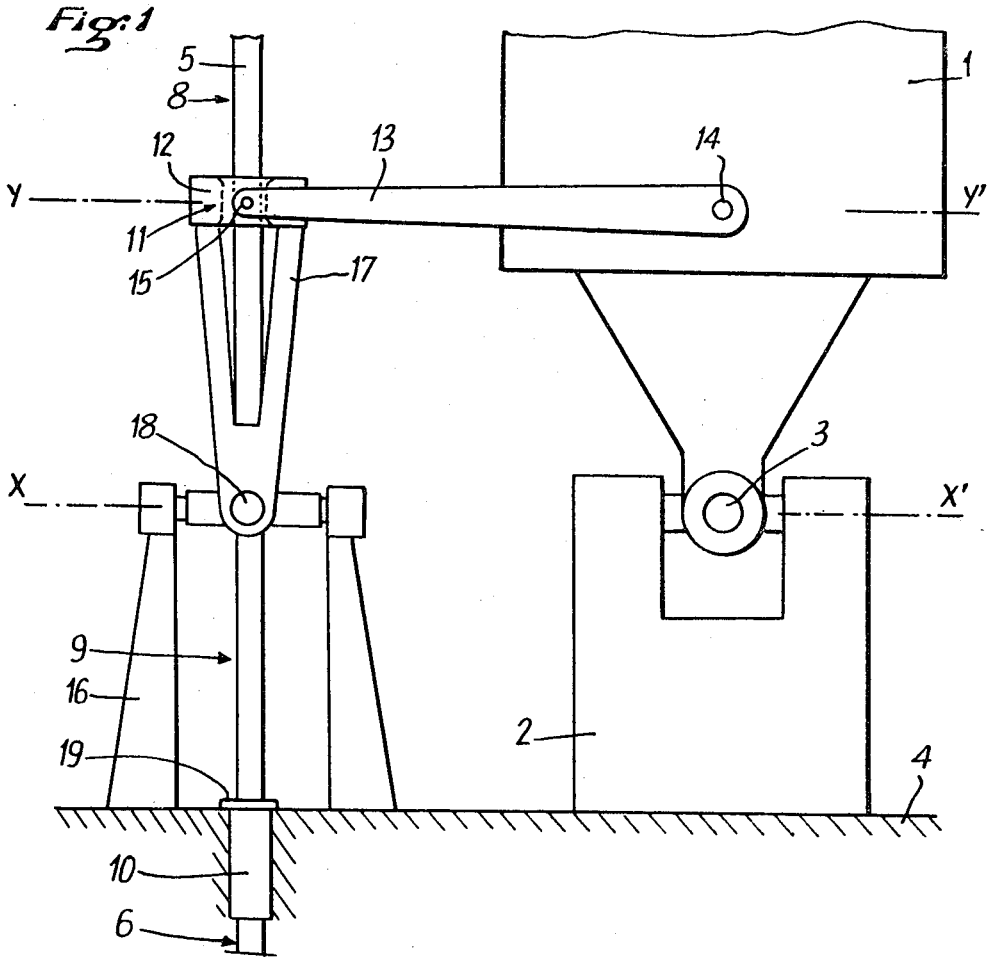
FIG. 1 is a schematic diagram of the arangement limiting the off-centering effect of a well column, according to a preferred embodiment of the invention.

Referring to FIG. 1, one finds, schematically represented, an articulated structure 1 resting on a base 2 by means of a universal joint 3 such as a Cardan joint, the base 2 being fixed on the sea bottom 4 by known means not shown.

Figure 3:
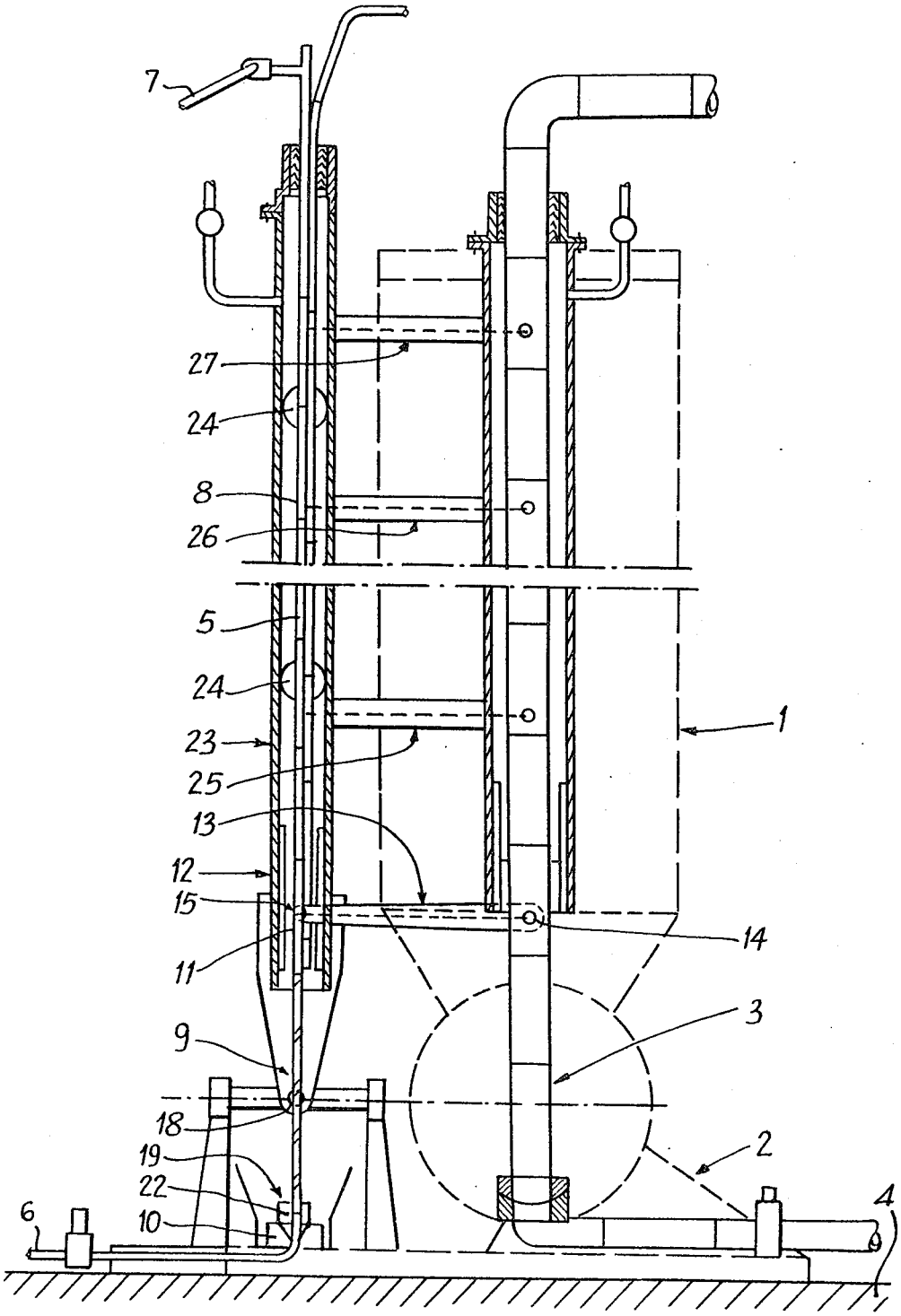
FIG. 3 is a delivery column having a continuous well guide.
Figure 4:
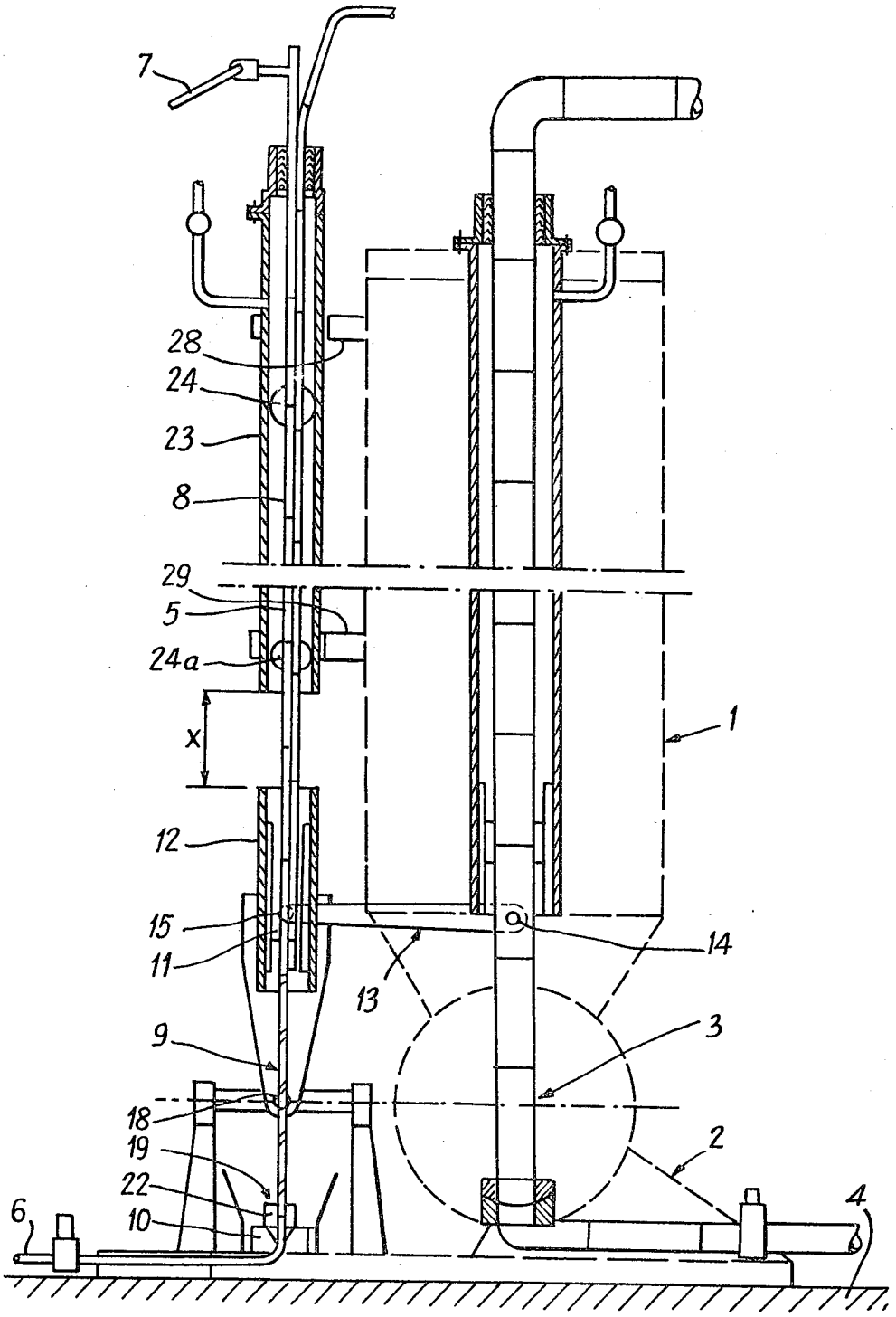
FIG. 4 is a delivery column having an interrupted well guide.

The articulated structure 1 is used among others as a support of one or more delivery columns such as column 5, connecting a base pipe 6 to an overhead discharge line, not represented on FIG. 1, represented with marking 7 on FIGS. 3 and 4.

Such a column 5 consists of production tubing members 8 connected to each other by unions; and of a lower production tubing member 9 ranging between 8 and 16 meters long. That lower member 9 is connected to a base pipe 6 by a bottom disconnecting coupler 10 constituting a housing. The lower member 9 is connected to the adjacent production tubing member of the column 5 by means of a coaxial union of a piston 11 moving in translation by telescoping into a cylindrical seat 12.

The cylindrical seat 12 is connected to the structure 1 by means of a first straight arm 13, equipped at its ends with a first articulation 14, the axis of which meets the axis of the structure 1, and with a second articulation 15, the axis of which meets the axis of the column, which is the axis of the seat 12, the axes of the first articulation 14 and of the second articulation 15 both being perpendicular to the plane defined by the axis of the structure and by the axis of the column, which is here the plane of the drawing.

The cylindrical seat 12 is connected to a second base 16 fixed on the sea bottom 4 by means of a second arm 17 extending the seat 12 and resting on that second base 16 by means of a second universal joint 18, the center of which is situated on the same side as the center of the first universal joint 3. The center of the second universal joint 18 is situated on the vertical of the center of the base housing 10 (bottom disconnecting coupler) of the lower tubing member 9. The second arm 17 extends the seat 12 in an arrangement such that the axis of the seat passes through the center of the second universal joint.

As the length of the first arm 13 between the axes of the two articulations 14 and 15 is equal to the distance between the centers of the universal joints 3 and 18, and as the distance between the axis of the articulation 15 and the center of the joint 18 is equal to the distance between the axis of the articulation 14 and the center of the joint 3, the points of FIG. 1 bearing markings 14, 15, 3 and 18 are the vertices of a rectangle when the structure 1 is vertical and of a parallelogram when the structure 1 is inclined.

The lower tubing member 9 passes into the center space of the universal joint 18.

The distance between the center of the seat 12 and the center of the second universal joint 18 is approximately equal to the distance between the center of the second universal joint 18 and the upper part 19 of the housing 10.

Figure 2:
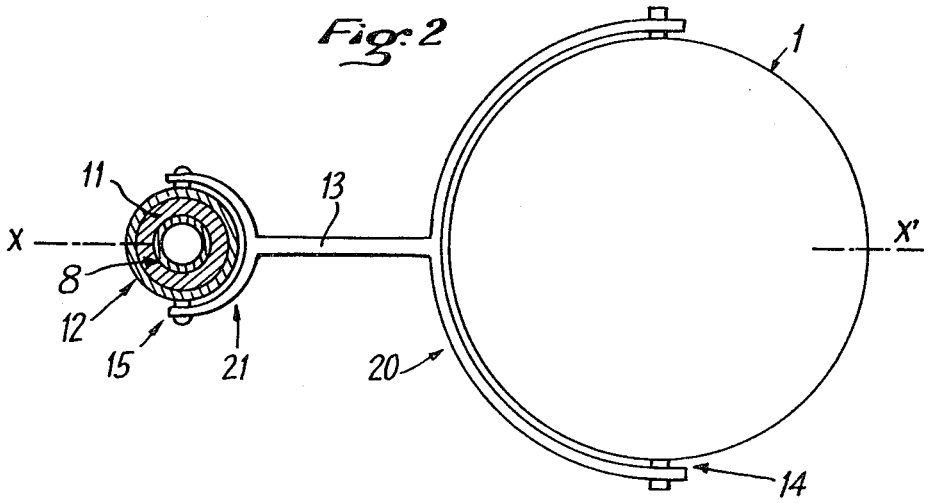
FIG. 2 is a schematic sectional view along horizontal plane line YY' of FIG. 1.

FIG. 2 illustrates a section of the arrangement along a horizontal plane defined by line YY' in FIG. 1. In FIG. 2 the outline of the schematic section of the articulated structure 1 appears as a circle. A straight section of the lower member 9 of the production tubing 8 is surrounded by a straight section of the union 11 which acts as a piston slidably movable in cylindrical seat 12.

The first arm 13 is articulated on the first articulation 14 by means of a stirrup 20 and on the second articulation 15 by means of a stirrup 21.

FIGS. 3 and 4 are cross-sectional schematic representations of the articulated structure 1 resting on the base 2 by means of the universal joint 3. Shown combined with that structure 1 is the delivery column 5 connecting the base pipe 6 to an overhead line 7.

Column 5 consists of production tubing members 8 connected to each other by unions, and of the lower member 9. The lower member 9 is connected at its lower end to the base pipe 6 by a disconnecting coupler 22 constituting a vertical housing of a known design; and at its upper end to the adjacent member of the column 5 by means of a coaxial member of a piston 11 moving in translation by sliding into a cylindrical seat 12.

The cylindrical seat 12 is connected to the universal joint 18 by two levers 13 and 17 of such lengths that the four joints 14, 15, 3 and 18 are the vertices of a parallelogram.

The column 5 is maintained coaxial with the well guide 23 by means of resilient centering elements 24.

In the embodiment shown in FIG. 3, the well guide 23 constitutes an extension of the seat 12. For the well guide 23 to follow the movements of the seat 12, the well guide is connected to the structure 1 by a multiple number of straight arms, such as 25, 26, 27, each of those arms being articulated at one end by means of a stirrup on an axis at right angles to the axis of the structure 1, and at the other end by means of a stirrup on an axis at right angles to the axis of the column 5. The arms 25, 26, 27 are constructed parallel to arm 13.

In the embodiment shown in FIG. 4, the well guide 23 is independent of the seat 12; and the lower end of the well guide 23 is separated from the upper end of the seat 12 by a distance X of several tens of meters.

The well guide 23 is connected to the structure 1 by a multiple number of rigid fastenings 28, 29, so that the axis of the well guide 23 is kept parallel to the axis of the structure 1.

Between the union of the piston 11 and the first centering element 24*a* of the column 5 inside the well guide, the column 5 assumes an S-shape to compensate for the variable shift between the axis of the seat and the axis of the well guide. A shift of several tens of centimeters over 20 meters is tolerable with the tubular materials used.

Figure 5:
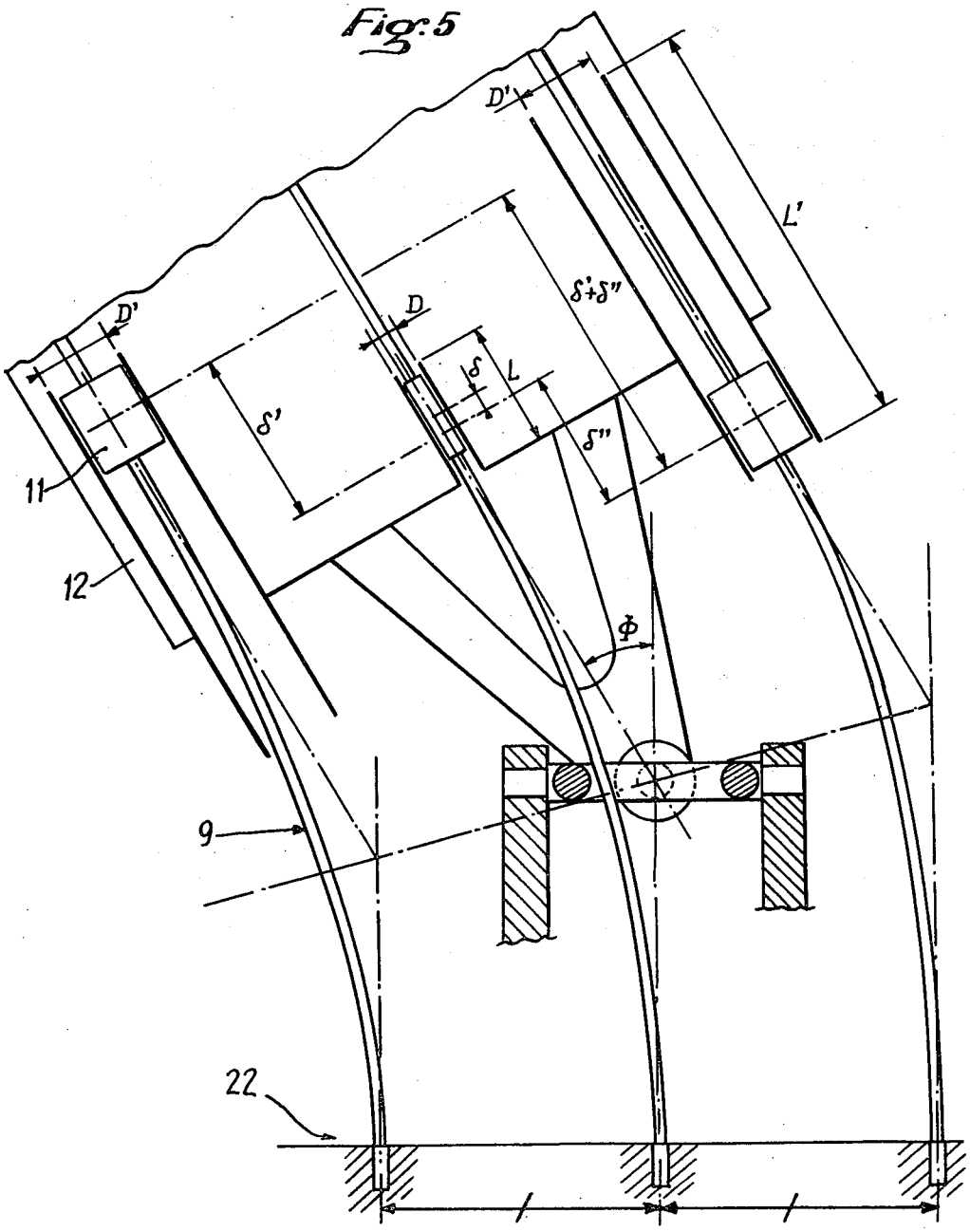
FIG. 5 illustrates deformation and displacement of the eccentric delivery columns according to the prior art.
Figure 6:
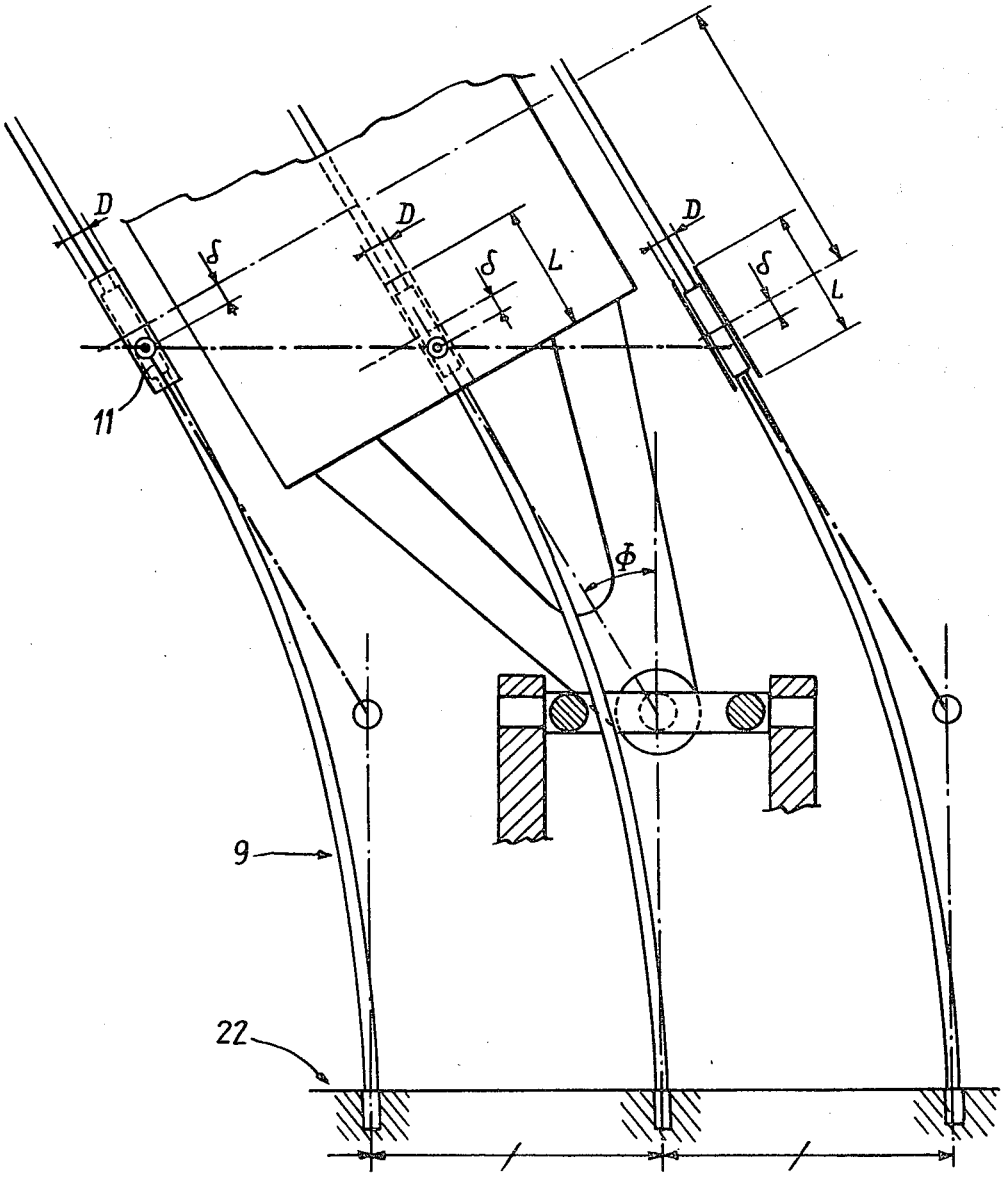
FIG. 6 illustrates deformation and displacement of the eccentric delivery columns, with the limiting arrangement of the present invention.

FIGS. 5 and 6 schematically represent the deformation of three parallel delivery columns, the first of which is arranged along the axis of the structure and the other two of which are symmetrically off-centered on both sides of the first, when the articulated structure acquires a certain inclination.

FIG. 5 represents the state of the delivery columns installed according to the prior art, in which the lower member 9 is connected at one end to the base by a housing imposing a vertical tangent, and is connected at the other end to the adjacent pipe section of the column by a housing on the piston 11, imposing a tangent along the axis of the union and then along the axis of the seat 12.

It can be observed that in relation to the rest position, in which the axis of the structure is vertical, the piston 11 is displaced by a distance $\delta$ for the column situated along the axis of the structure, by a distance $\delta'$ for the column situated on the side toward which the structure inclines and by a distance $\delta''$ for the column situated opposite the side toward which the structure inclines. The total oscillation on deflection of the union 11 for an eccentric column is then equal to $\delta'+\delta''$, necessitating a guide length L' exceeding L.

Because of the extent of that deflection $\delta'+\delta''$, it is necessary to give the cylindrical seat 12 in which the piston 11 slides relative to an eccentric column, a diameter D' greater than the diameter D of the seat of the column arranged along the axis of the structure, in order to prevent mechanical interference between the flexible rod 9 and the walls of the cylindrical seat 12.

FIG. 6 represents the state of the delivery columns installed by using the arrangement according to the invention which limits the off-centering effect.

As seen in FIG. 6 the geometry of the present invention is such that for the same inclination $\Phi$ of the structure as in FIG. 5, displacement of the union 11 is the same for the eccentric columns as for the column situated along the axis of the structure: the deflection of the union is then $\delta$ and, therefore, considerably reduced in relation to the value of $\delta'+\delta''$.

The present arrangement for limiting the off-centering effect offers the advantage of limiting the stresses in the lateral bending members 9 to the stress value reached along the same bending member if it were disposed along the axis of the structure, that is, to the minimum value.

Furthermore, this arrangement, by reducing the deflection of the union 11 to the minimum value which is that observed on the union of the column installed along the axis of the structure, makes it possible to avoid the difficulties due to the geometric interferences against which it is necessary to guard with the installations according to FIG. 5, while giving the seat 12 and the piston 11 the same diameter for an eccentric column as for the column along the axis of the structure.

The function of the column 5 and of its members 8 and 9 is generally to conduct effluents from deposits below the sea bottom to the surface as well as from the surface to the deposit. For this purpose column 5 can be used by itself or can contain several juxtaposed or concentric pipes allowing the transfer of fluids of different nature or under different temperature or pressure conditions, in the same direction or in opposite directions.

Figure 7:
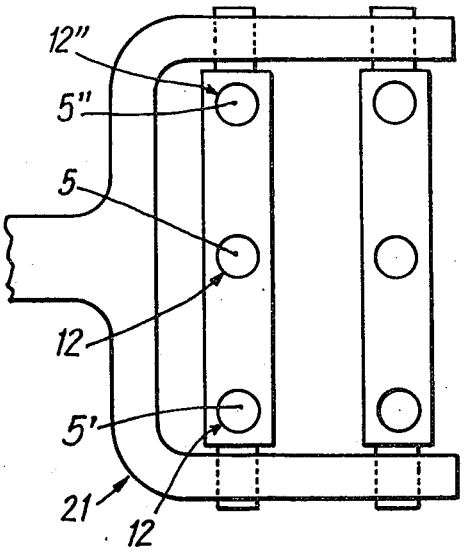
FIG. 7 illustrates the grouping of delivery columns according to a first alternative embodiment of the invention.
Figure 8:
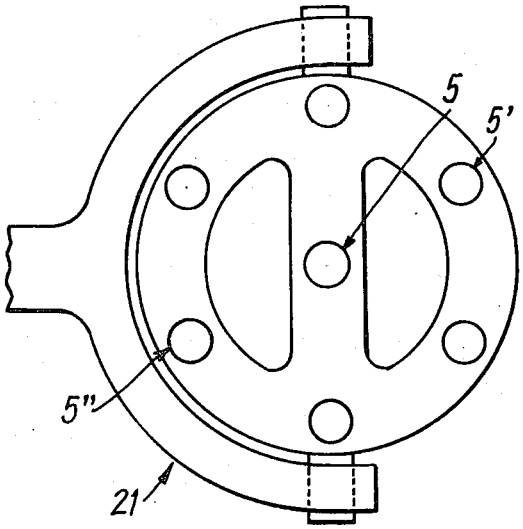
FIG. 8 illustrates the grouping of delivery columns according to a second alternative embodiment of the invention.

FIGS. 7 and 8 illustrate installations in which several delivery columns are combined with the column 5, being required to have their respective pistons 11 slide into cylindrical seats 12 of axes parallel to the axis of the seat 12 and articulated on the same stirrup 21.

Figure 9:
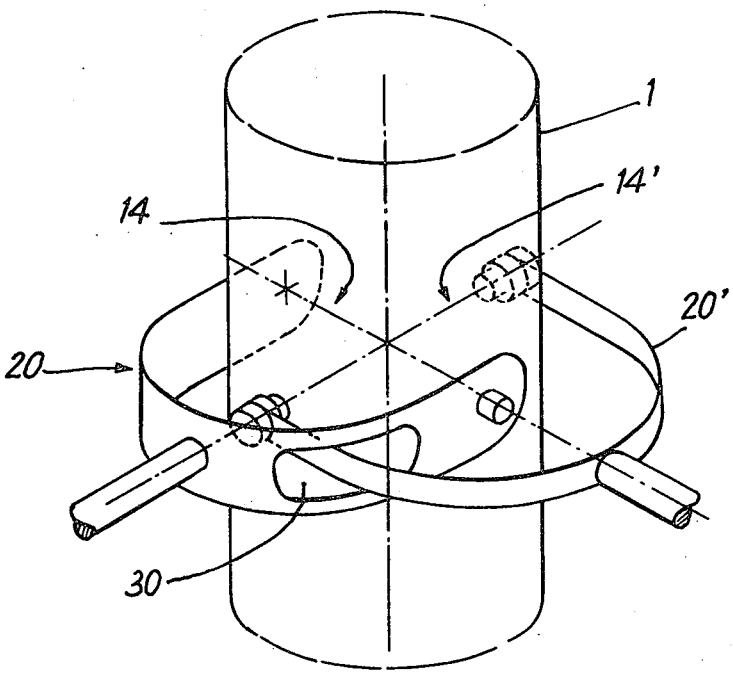
FIG. 9 illustrates the passage of one stirrup across another according to a feature of the invention.

FIG. 9 illustrates an installation in which the stirrup 20 has a hole 3 for the passage of another stirrup 20' articulated on an axis forming a given angle with the axis on which stirrup 20 is articulated.

The arrangement described herein for limiting the off-centering effect can, of course, be used for several delivery columns placed around the structure 1, and can also be applied to a group of columns similar to the column 5.

What is claimed is:

1. A delivery column for a deep-water well structure for communicating with a region beneath the water bottom, said structure having a vertical axis, said structure resting on a first base and articulated with respect thereto about a first axis, said column containing a plurality of pipes connected to each other end to end, comprising an upper tubular part rising near the surface of the water, and a lower tubing member connected at one end to a base pipe by means of a disconnecting coupler and at the other end to the lower end of the lower tubing member of the column by means of a coaxial union of a piston mounted for longitudinal sliding movement in a generally cylindrical seat wherein said seat 12 is connected:

at one end to the structure by means of a first arm articulated at each of its ends, the axis of one end articulation coinciding with the axis of the structure, and the axis of the other end articulation coinciding with the axis of the column, the axes of both articulations being perpendicular to the plane defined by the axis of the structure and the axis of the column;

at the other end to a second base by means of a second arm extending from the seat and coupled to said second base by means of a universal joint, the center of said joint being situated horizontally adjacent the axis of articulation of the structure on the base thereof, the center of the universal joint lying on a vertical center line of the base housing of the lower tubing member;

said second arm being such that the axis of the seat passes through the center of the universal joint, the centers of articulation of said structure on the base thereof and of the universal joint and the centers of the two end articulations of the first arm forming the vertices of a parallelogram.

2. A delivery column according to claim 1, wherein the distance between the center of the seat and the center of the universal joint is approximately equal to the distance between the center of the universal joint and the base housing of the lower tubing member.

3. A delivery column according to claim 1, wherein the articulated arms are equipped at each end with a stirrup containing two diametrically opposite bearings having supporting pins, said pins being respectively fixed at two diametrically opposite points of a straight section of the seat or of the pipe and of a straight section of the structure.

4. A delivery column according to claim 1, wherein the seat is extended upwardly by a well guide, further comprising centering elements integral with the column and bearing against the inner wall of the well guide, further comprising a plurality of arms interconnecting the column and the structure, each of said arms connect (i) an axis at right angles to the axis of the well guide and situated a distance away from the second universal joint and (ii) an axis at right angles to the axis of the structure and situated the same distance away from the first mentioned universal joint.

5. A delivery column according to claim 1, wherein the seat has a length greater than the maximum amplitude of vertical displacement of the piston, the column having a tubular part free over a certain distance from the piston, further comprising a number of centering elements for keeping the column substantially straight along the axis of a well guide, said well guide being fixed along the structure and having its axis parallel to the axis of the structure.

6. A delivery column according to claim 3, further comprising at least one additional cylindrical seat having an axis parallel to the axis of the first-mentioned seat, articulated on the same stirrup and which is suitable for passage of a column combined with the first-mentioned column.

7. A delivery column according to claim 1, wherein said structure is coupled to the base thereof by a universal joint, a swivel joint or a resilient support member.

* * * * *